United States Patent [19]

Halem

[11] 4,087,662

[45] May 2, 1978

[54] AXIAL TORSION PRESSURE TRANSDUCER

[76] Inventor: Norman Halem, 3053 Skyline Dr., Cocoa, Fla. 32922

[21] Appl. No.: 627,748

[22] Filed: Oct. 31, 1975

Related U.S. Application Data

[62] Division of Ser. No. 428,073, Dec. 26, 1973, Pat. No. 3,918,543.

[51] Int. Cl.[2] ..... H01H 35/36

[52] U.S. Cl. ..... 200/81.8; 73/716; 340/240

[58] Field of Search ..... 200/81.8, 83 C, 83 D; 340/240; 73/412, 411, 418; 337/306, 307, 325

[56] References Cited

U.S. PATENT DOCUMENTS

| | | | |
|---|---|---|---|
| 48,331 | 6/1865 | Wigal | 73/411 |
| 2,067,959 | 1/1937 | Wesson | 200/81.8 |
| 2,356,174 | 8/1944 | Olken | 200/81.8 |
| 2,993,971 | 7/1961 | Pflanz | 200/81.8 |
| 3,095,745 | 7/1963 | Kirwan | 73/412 |
| 3,533,294 | 10/1970 | Fahy | 200/81.8 |
| 3,818,764 | 6/1974 | Wagner | 200/81.8 |

*Primary Examiner*—Gerald P. Tolin
*Attorney, Agent, or Firm*—Duckworth, Hobby & Allen

[57] ABSTRACT

Disclosed is a system of the type comprising an engine for performing a primary work function and at least one secondary work function, in which operation of the engine is characterized by alternating periods of primary work function load and no-load conditions, the system including means for loading the engine with the secondary work function only during the periods of primary work function no-load condition.

2 Claims, 5 Drawing Figures

AXIAL TORSION PRESSURE TRANSDUCER

This is a division of application Ser. No. 428,073 filed Dec. 26, 1973, now U.S. Pat. No. 3,918,543.

BACKGROUND OF THE INVENTION

1. Field of the Invention

The present invention relates to engine-driven systems in which the engine is required to perform a plurality of work functions, and in particular, to such systems in which the work functions are selectively coupled to the engine in order to increase overall system efficiency.

2. Description of the Prior Art

Automobile engines presently are required to operate a variety of accessories as secondary work functions, as well as to perform the primary work function of motivating the vehicle. The secondary work functions include battery charging, air conditioner compressor drive and operation of pollution control equipment, to name but a few. As is well known, each additional secondary work function reduces the amount of power that can be devoted to the primary work function of driving the vehicle, an efficiency reduction which is ultimately manifested in larger fuel requirements per unit distance the vehicle travels.

There have been suggestions in the prior art for removing the load of some of the vehicle accessories only during periods when the vehicle requires additional power for rapid acceleration. Haroldson, in U.S. Pat. No. 3,462,964, discloses a system employing a manifold vacuum switch adapted to switch off the load represented by an automobile air conditioner compressor only during periods of rapid acceleration Kaye, in U.S. Pat. No. 3,602,005, discloses a similar arrangement also employing means coupled to the spark advance. Another arrangement is disclosed in U.S. Pat. No. 3,186,184 to Pruitt. See also the following U.S. Pat. Nos. 2,107,341 to Peo; 2,268,667 to Mendez; 2,929,226 to Baker et al.; and 3,121,314 to Koyanagi.

SUMMARY OF THE INVENTION

An important aspect of the present invention rests on the realization of the principle that vehicle engine powered accessories need not utilize the engine as a power source. Other forms of energy, already present in a moving vehicle, can provide sufficient power to achieve normal accessory operation without burdening the fuel supply. A source of energy is available in any moving mass. This energy form, momentum, is manifested by a change of speed of a given mass per unit of time. This action, when translated into physical terms, can generate many units of horsepower. Thusly, the momentum present in a moving vehicle as the vehicle reduces speed, or decelerates, is translated into an energy form whose power must be expended in some other energy form. When relating to a moving vehicle, this energy is wasted and transformed into heat, generated by the friction of wheels on a pavement, moving parts, engine compression and vehicle brakes.

The present invention accordingly contemplates a system of the type comprising an engine for performing a primary work function and at least one secondary work function, in which operation of the engine is characterized by alternating periods of primary work function load and no-load conditions, the system further including means for loading the engine with the secondary work function only during the periods of primary work function no-load condition.

A system embodying the present invention will hereinafter be described with reference to FIG. 2. In order to more clearly define the principal upon which the present invention is based, there is illustrated in FIG. 1 a chart reflecting the three conditions under which an engine driven vehicle operates and the means in which energy sources are utilized in the present invention to power secondary work functions. As is well known, operation of any vehicle is characterized by alternating periods of acceleration and deceleration with occasional intervening periods of constant vehicle velocity, as is shown in the upper portion of FIG. 1. The durations of these respective periods, of course, vary from time to time depending upon a variety of factors including braking, road conditions, and so forth. In accordance with the present invention, the vehicle system includes means for energizing at least one of the accessories only during periods of vehicle deceleration, during which time power required to perform secondary work functions is supplied from the vehicle momentum and not the fuel consuming engine.

THE DRAWING

DETAILED DESCRIPTION

Figure 1:
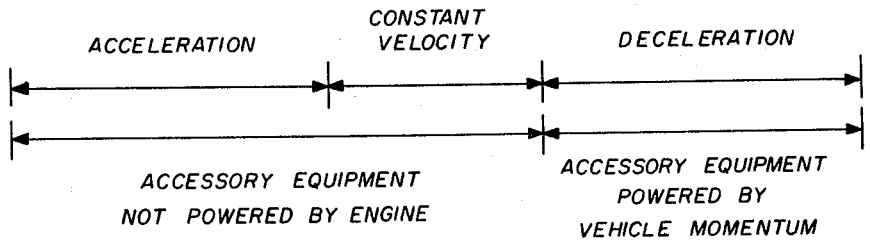
FIG. 1 is a diagram illustrating the principle established by the system of the present invention.
Figure 2:
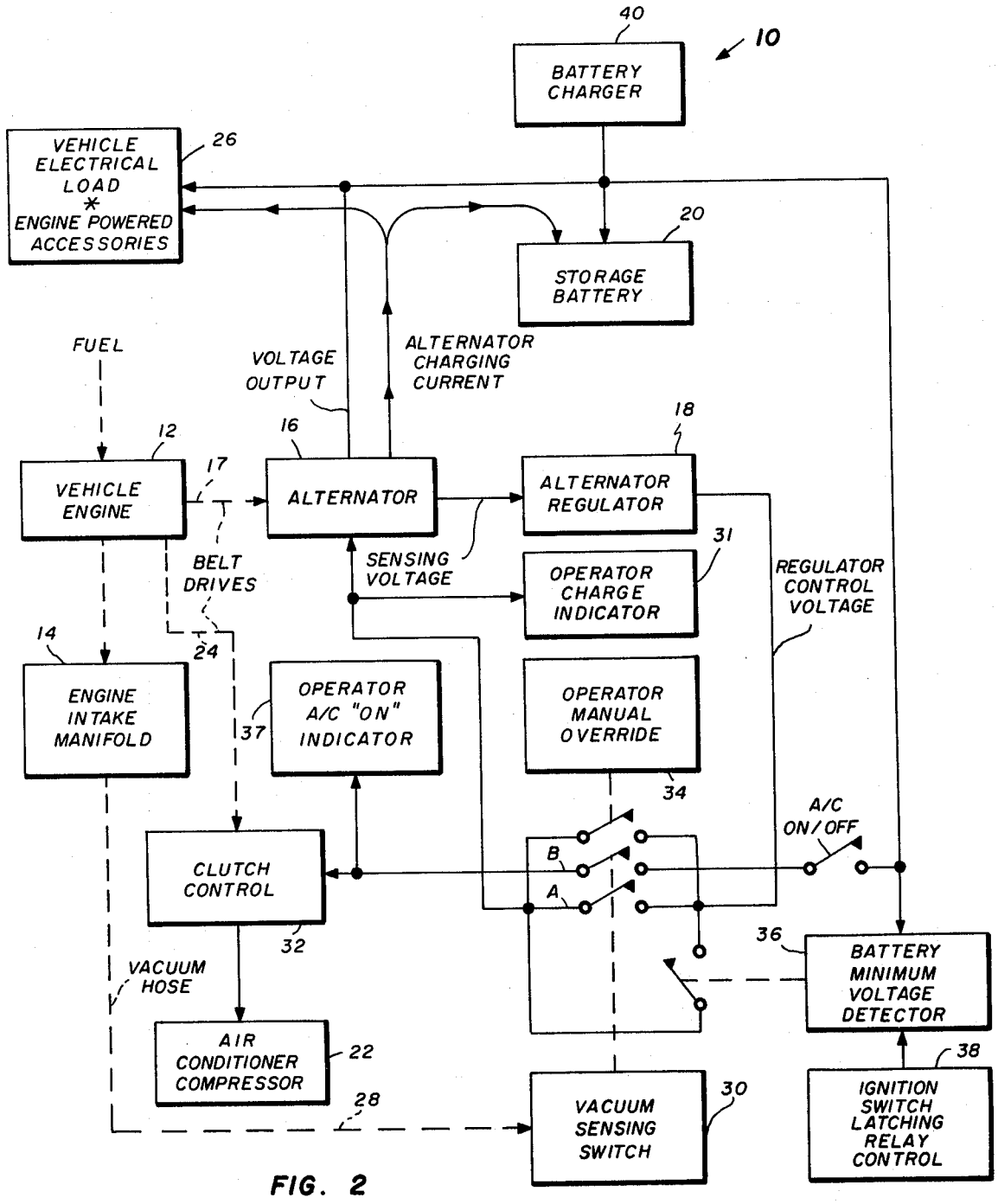
FIG. 2 is a block diagram illustrating the system in accordance with the present invention.

The system embodying this concept will now be described with reference to FIG. 2. The system described provides means for harnessing vehicle momentum to provide energy sufficient for performing secondary work functions in place of conventional fuel consuming power sources. Although the foregoing description relates to automobile systems, it is by no means intended to be limited in scope to such. The description, for ease in presentation, describes means for accomplishing the above stated objectives on a specific type of vehicle, but as will be evident to those skilled in the art, means can be employed in any vehicle or machine utilizing the same energy source for primary and secondary work functions.

The vehicle system, referred to generally as 10, includes an internal combustion engine 12 having an intake manifold 14 associated therewith. The system 10 further includes an alternator 16 coupled to the vehicle engine by a drive belt 17, with an alternator regulator 18 coupled to the alternator 16. The vehicle 10 further includes a storage battery 20 and additional electrical load and engine power and accessories, referred to generally as 26. The vehicle 10 may also include an air conditioner compressor 22 and clutch control 32 coupled to the vehicle engine by a drive belt 24. The apparatus described thus far and shown by block diagrams in FIG. 2 all constitute apparatus presently found on many internal combustion engine powered vehicles. One modification which might be made to this apparatus is to utilize a higher amperage rated storage battery 20 than is customarily employed.

In accordance with the present invention, the vehicle 10 is further provided with a vacuum hose 28 which is coupled to a vacuum sensing switch 30. The vacuum sensing switch 30, as shown, contains two switch elements, A and B. Multiple vacuum sensing switches containing single or multiple switch functions may also be employed to control the necessary number of secondary work functions. An operator manual override switch 34 is provided in parallel with switch A of the vacuum sensing switch 30 so as to provide a manual override capability during periods when engine conditions dictate switch A open, as described below. The system 10 further includes a minimum voltage detector 56 to which an ignition switch latching relay control 38 is coupled.

The system 10 in FIG. 2 operates in the following manner. During acceleration of the vehicle 10 or during periods of constant velocity, the vehicle 10 is motivated by the engine 12, the air conditioner load is off and the ignition system, lights and accessories represented at 26 are powered by the storage battery 20.

During periods of deceleration of the vehicle 10, the vehicle's momentum reduces engine loading requirements, resulting in an increased vacuum (decrease in pressure) in the intake manifold 14. At a predetermined point, the vacuum sensing switch 30 closes switch contact which serially connects the alternator regulator 18 to the rotating field winding of the alternator 16. This in turn increases the output of the alternator 16 which then provides current to charge the storage battery 20 and power the remainder of the electrical system 26. An indicator lamp 31 within the vehicle's passenger compartment is illuminated and the sensing voltage between the alternator 16 and the regulator 18 function in a normal manner, i.e. causes a variation in the rotating field voltage in order to control the charging rate to the storage battery 20. Additionally, closure of contact B energizes the air conditioner compressor 22 to the engine 12 and lamp 37 within the vehicle operator compartment is illuminated. The exact manner in which the manifold sending switch 30 determines the point at which deceleration occurs will hereinafter be described in greater detail.

Upon termination of vehicle deceleration, the change of loading of the engine 12 is sensed by the vacuum sensing switch 30, and contacts A and B are opened. This removes the rotating field voltage of the alternator 16, which in turn removes the alternator output voltage and interrupts the charging current to the battery 20. Thereafter, the alternator 16 presents a negligible mechanical load to the vehicle engine 12 through the belt 17. The charge indicating lamp 31 switches off and the storage battery 20 will thereafter power the vehicle electrical load 26. The battery minimum voltage detector 36 monitors the voltage of the battery 20, whereupon a preset terminal voltage will energize the sensing switch and close its contact to again load the alternator 16 on the engine, in the event the battery voltage falls below a predetermined level. A manual over-ride switch 34, which may be located in the passenger compartment, may override any non-charging condition of the alternator 16 and effect normal charge of the battery 20 at the operator's discretion. Concurrently with the opening of contact A, contact B of the vacuum sensing switch 30 opens, deenergizing the clutch control 32, relieving engine 12 of the air conditioner 22 load and extinguishing the operator compartment air conditioner indicator 37. An external storage battery charging system 40 may be provided for over night or emergency battery charging.

Figure 3:
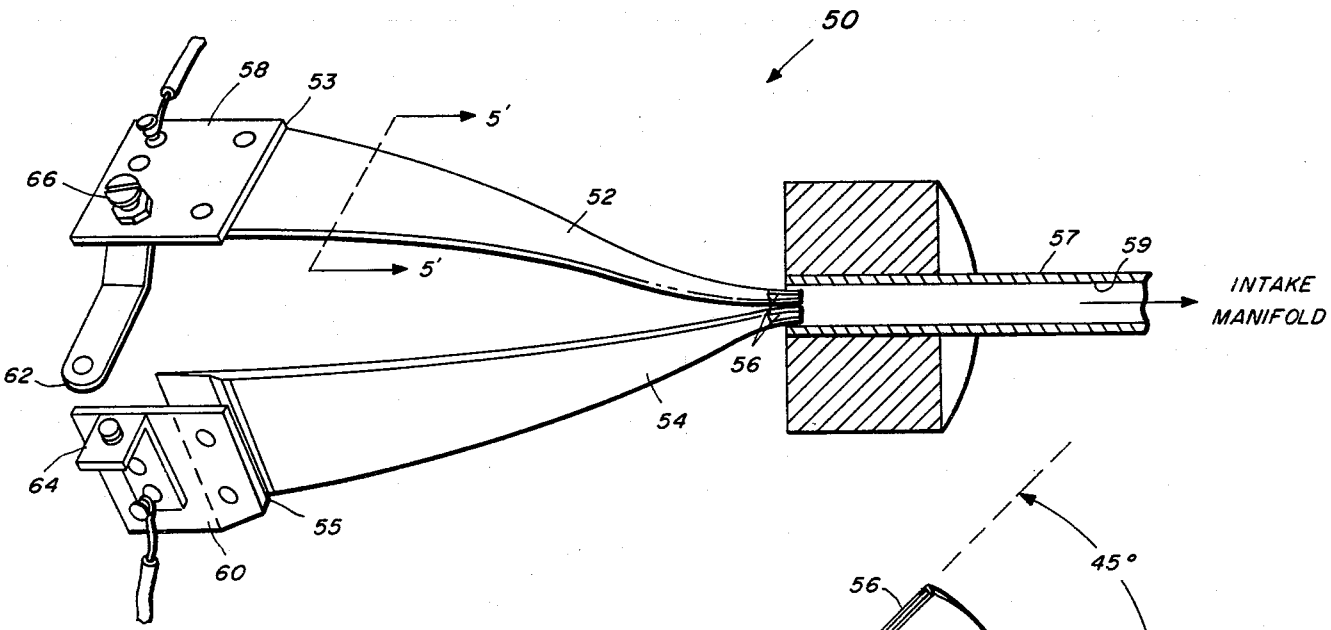
FIG. 3 is a side view of a manifold vacuum switch in accordance with the present invention.
Figure 4:
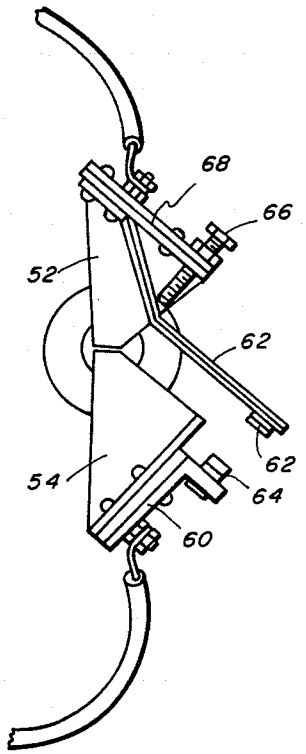
FIG. 4 is an end view of the manifold vacuum switch of FIG. 3.
Figure 5:
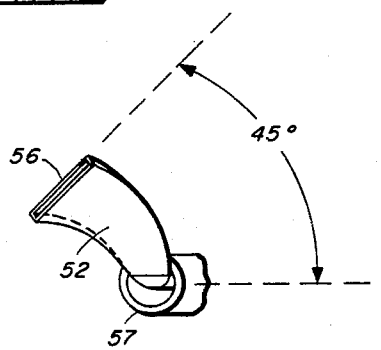
FIG. 5 is a cross section of a portion of the apparatus of FIG. 3, taken along the line of 5–5'.

A manifold vacuum switch in accordance with the present invention is shown in FIGS. 3, 4 and 5 and described with reference thereto. The manifold vacuum switch, referred to generally as 50, includes two flat, flexible members 52, 54 each having a respective sealed end 53, 55 and a hollow core 56. Each hollow core of the flat, flexible members 52, 54 communicates with the intake manifold via the hollow core 59 of a vacuum hose 57.

Noting FIG. 5, each flat, flexible member 52, 54 defines a twist of preferably about 45° in a direction axial with the hollow core 56. In use, pressure changes in the manifold cause flexing of each member 52, 54 in the axial direction, as shown by arrows in FIG. 3. Preferably, the members 52, 54 are twisted in opposite directions. The vacuum switch 50 further includes a pair of switch contacts 61, 64, each contact being carried by a respective plate 58, 60 mounted at the sealed end 53, 55 of the corresponding flexible member 52, 54. The contacts 62, 64 are juxtaposed with respect to each other, one of the carrying plates 58 including a threaded screw therethrough bearing against the corresponding contact 62 to provide means for adjusting the throw of that contact.

As shown in FIG. 4, at least one of the carrying plates, for example carrying plate 58, may comprise a bi-metallic element 68 which provides means serially coupled to the contact 62 for thermally latching the contact 62 to contact 64 when sufficient current has passed through the bi-metallic element 68 to create a bending moment therein. By virtue of the bi-metallic element 68, the position of contact 62 with respect to contact 64 may be automatically compensated in response to variations in temperature. Accordingly, contacts 62 and 64 will open and close only in response to pressure changes within the hollow cores of the flexible members 52 and 54 and will not be affected by temperature changes.

The manifold vacuum switch 50 operates in the following manner. The space between the contacts 62, 64 is preset in a manner as hereinafter described. When the intake manifold pressure changes, each of the members 52, 54 flex in the axial direction, and because of the opposite twist moves towards each other thereby effecting closure of the contacts 62, 64.

In accordance with the present invention, the intake manifold pressure necessary to effect operation of the system as described above, varies as a function of several factors; vehicle size, type of engine, engine loading, condition of the engine, condition of the ignition system, geographic location, and the trade-off between accessory operation efficiency and fuel consumption. Each factor must be considered when implementing the system of the present invention, but can be determined empirically for each engine with the use of a test instrument to determine the optimum deceleration point or by operator-adjust, trial and error; i.e., adjust the device to provide illumination of the charge indicator lamp 31, located in the operator compartment, to coincide with vehicle deceleration as the operator releases the engine throttle. The optimum setting will be that which provides the best fuel mileage. It will, of course, be appreciated by those skilled in the art that, because of variations in the factors set forth above, the loading of any given accessory onto the engine precisely at the threshold of deceleration would be difficult over extended periods of time. It is therefore a primary purpose of this invention to approximate the threshold of deceleration as nearly as is practicable.

I claim:

1. A device for translating a pressure change into a mechanical motion, said device comprising:

a first flat, flexible member having a sealed end and a hollow core, said flat member defining a twist in a direction axial with said hollow core;

a second flat, flexible member having a sealed end and a hollow core, said flat member defining an axial twist opposite to that of said first flat, flexible member, said sealed end of said second member being disposed in juxtaposed relation to said sealed end of said one member, whereby pressure changes in said cores cause flexing of said members in said respective axial directions;

a pair of juxtaposed switch contacts, each contact being carried by one of said flexible members at the respective sealed end thereof;

means for adjusting the throw of one of said switch contacts whereby said contacts are adapted to close only upon sensing by said members of a predetermined pressure in the corresponding cores; and thermal-latching means serially coupled to one of said contacts.

2. The combination recited in claim 1 wherein said thermal-latching means comprises a bi-metallic element.

* * * * *